US010692646B2

(12) United States Patent
Lee et al.

(10) Patent No.: US 10,692,646 B2
(45) Date of Patent: Jun. 23, 2020

(54) SINGLE LITZ WIRE TRANSFORMERS

(71) Applicant: Toyota Motor Engineering & Manufacturing North America, Inc., Erlanger, KY (US)

(72) Inventors: Jae Seung Lee, Ann Arbor, MI (US); Jongwon Shin, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 274 days.

(21) Appl. No.: 15/653,635

(22) Filed: Jul. 19, 2017

(65) Prior Publication Data

US 2019/0027301 A1 Jan. 24, 2019

(51) Int. Cl.

| | |
|---|---|
| ***H01F 27/32*** | (2006.01) |
| ***H01F 27/30*** | (2006.01) |
| ***H01F 27/28*** | (2006.01) |
| ***H01F 41/08*** | (2006.01) |
| ***H01F 41/07*** | (2016.01) |
| ***H01F 17/06*** | (2006.01) |
| *H01R 4/10* | (2006.01) |
| *H01B 7/30* | (2006.01) |

(52) U.S. Cl.

CPC ..... *H01F 27/324* (2013.01); *H01F 17/062* (2013.01); *H01F 27/2823* (2013.01); *H01F 27/306* (2013.01); *H01F 41/07* (2016.01); *H01F 41/08* (2013.01); *H01B 7/30* (2013.01); *H01R 4/10* (2013.01)

(58) Field of Classification Search

CPC ..... H01B 13/02; H01F 27/28; H01F 27/2866

See application file for complete search history.

(56) References Cited

U.S. PATENT DOCUMENTS

| | | | |
|---|---|---|---|
| 8,902,033 | B2 | 12/2014 | Shepard et al. |
| 8,975,523 | B2 | 3/2015 | Silva |
| 2004/0119577 | A1 | 6/2004 | Weger |
| 2009/0302986 | A1 | 12/2009 | Bedea |
| 2013/0021755 | A1 | 1/2013 | Lui et al. |
| 2014/0153209 | A1 | 6/2014 | Nam et al. |
| 2015/0001950 | A1 | 1/2015 | Chung et al. |

FOREIGN PATENT DOCUMENTS

| | | | | |
|---|---|---|---|---|
| GB | 444564 | A | * | 3/1936 |
| GB | 620946 | | * | 4/1949 |
| GB | 1451842 | A | * | 10/1976 |
| WO | 1982001627 | A1 | * | 5/1982 |
| WO | 1984004994 | A1 | * | 12/1984 |
| WO | 2010060593 | A1 | | 6/2010 |
| WO | 2012166134 | A1 | | 12/2012 |

* cited by examiner

*Primary Examiner* — Carl J Arbes

(74) *Attorney, Agent, or Firm* — Dinsmore & Shohl LLP

(57) ABSTRACT

Transformers having a plurality of windings from a single Litz wire, as well as systems including such transformers and methods of providing such transformers are disclosed. A transformer includes a core and a single Litz wire having a plurality of individual strands of conductive material. The plurality of individual strands of conductive material are separated into a plurality of groups, each one of the plurality of groups being a winding of the transformer such that the transformer comprises a plurality of windings.

20 Claims, 4 Drawing Sheets

SINGLE LITZ WIRE TRANSFORMERS

TECHNICAL FIELD

Embodiments described herein generally relate to electrical transformers and, more specifically, to electrical transformers having a plurality of windings in a single Litz wire.

BACKGROUND

Electrical transformers are widely used for a variety of purposes, such as to transmit alternating current (AC) power between circuits without electrical contact between the circuits. However, leakage of magnetic linkage between windings can cause loss in power and can generate excessive electromagnetic interference (EMI).

Litz wire, which is a wire that includes a plurality of individual strands of conductive material that are braided, stranded, or woven together into a bundled cable-like structure, may be used for the various windings of an electrical transforming. However, such transformers that utilize Litz wire for windings generally use a single Litz wire for each winding, which is inefficient and costly, as a plurality of Litz wires must be used for a plurality of windings.

Accordingly, a need exists for a transformer having windings comprised of a single Litz wire, where the Litz wire is coupled to two or more pairs of terminals.

SUMMARY

In an embodiment, a transformer includes a core and a single Litz wire having a plurality of individual strands of conductive material. The plurality of individual strands of conductive material are separated into a plurality of groups, each one of the plurality of groups being a winding of the transformer such that the transformer includes a plurality of windings.

In another embodiment, a transformer includes a toroidal core and a single Litz wire wrapped around at least a portion of the toroidal core. The single Litz wire includes a plurality of individual strands of conductive material. The plurality of individual strands of conductive material is arranged into a plurality of windings such that each one of the plurality of windings includes one or more of the plurality of individual strands.

In yet another embodiment, a system includes a transformer. The transformer includes a core and a single Litz wire wrapped around at least a portion of the toroidal core. The single Litz wire includes a plurality of individual strands of conductive material. The plurality of individual strands of conductive material is arranged into a plurality of windings such that each one of the plurality of windings comprises one or more of the plurality of individual strands.

These and additional features provided by the embodiments of the present disclosure will be more fully understood in view of the following detailed description, in conjunction with the drawings.

BRIEF DESCRIPTION OF THE DRAWINGS

The embodiments set forth in the drawings are illustrative and exemplary in nature and not intended to limit the disclosure. The following detailed description of the illustrative embodiments can be understood when read in conjunction with the following drawings, where like structure is indicated with like reference numerals and in which.

DETAILED DESCRIPTION

Figure 1A:
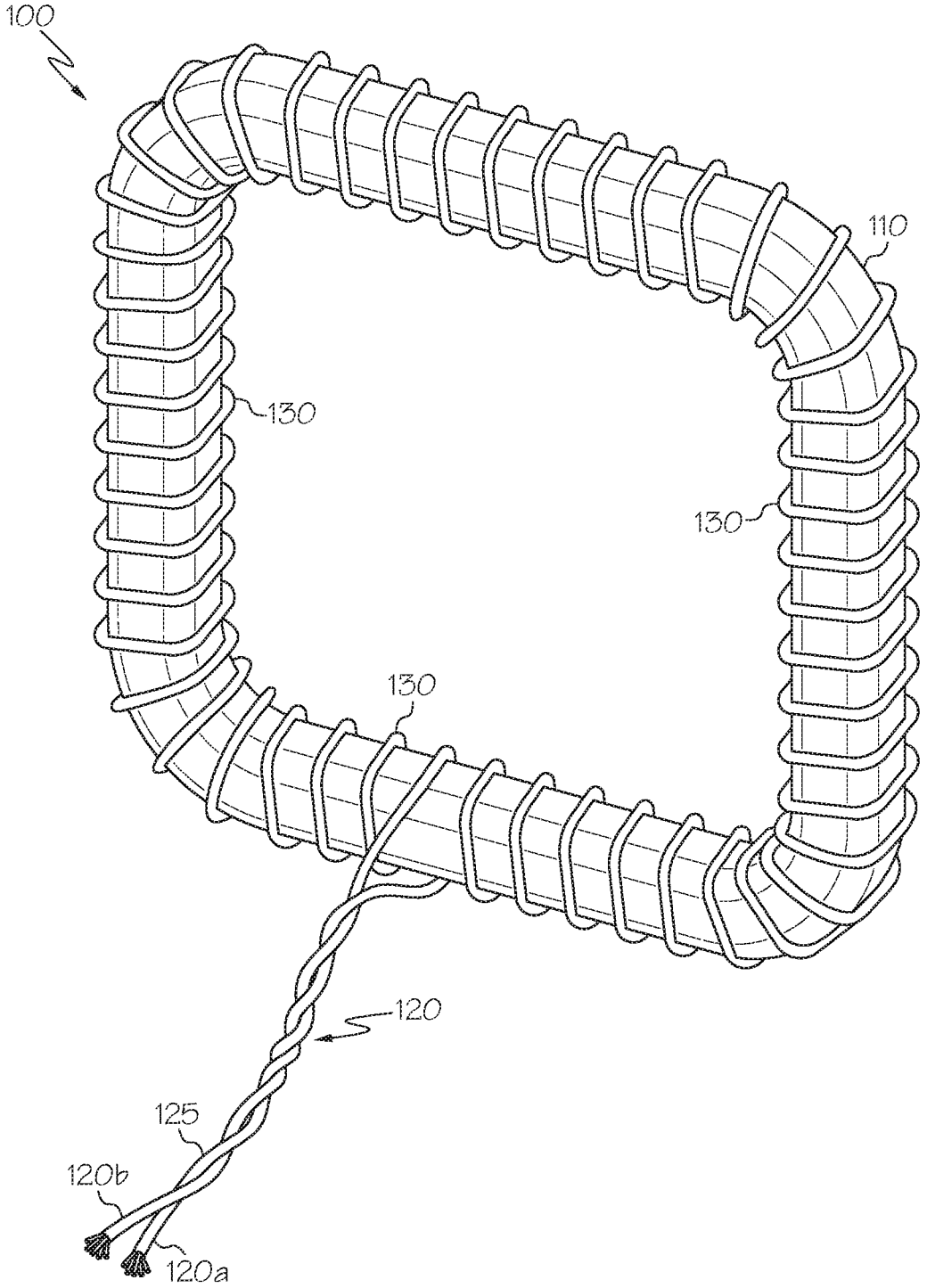
FIG. 1A depicts a perspective view of an illustrative transformer having a single Litz wire according to one or more embodiments shown and described herein.

Embodiments disclosed herein include transformers having windings made from a single Litz wire, as well as systems including such transformers and methods of providing such transformers. The various individual strands in a single Litz wire are grouped into a plurality of strand groups, where each strand group is coupled between a pair of terminals. As such, a single Litz wire can be coupled to at least two pairs of terminals. Because the individual strands are in close proximity to one another and are electrically isolated from one another, they can increase coupling by reducing leakage inductance between windings and/or decrease conduction loss by reducing AC resistance. As a result, the transformer operates more efficiently, is less likely to be damaged due to conduction loss, but does not add extra bulk or construction costs that would occur with additional wires and/or additional shielding in wires.

As used herein, a "Litz wire" refers to a wire that includes a plurality of individual strands of conductive material that are braided, stranded, or woven together into a bundled cable-like structure that is covered with an outer jacket. Each of the individual strands in the Litz wire is constructed of an electrically conductive material. In addition, each of the individual strands is electrically insulated from the other individual strands by an electrical insulator (i.e., each strand is coated with an electrical insulator material) that is separate from the outer jacket. The braided, stranded, or woven features of the individual strands may be in a weaving or twisting pattern such that the individual strands are located on an exterior of the bundle for a length of the Litz wire (where the electromagnetic field changes are weakest and the strands exhibit low resistance), and are located on an interior of the bundle for a length of the Litz wire (where the electromagnetic field changes are the strongest and the strands exhibit low resistance). In addition, if each strand has a comparable impedance, a current applied to the Litz wire is distributed equally among every strand within the Litz wire that contacts the source of the current. This allows the interior of the Litz wire to contribute to the overall conductivity of the bundle. That is, the magnetic fields generated by current flowing through the individual strands of the Litz wire are in directions such that they have a reduced tendency to generate an opposing electromagnetic field in the other strands. As such, for the Litz wire as a whole, the skin effect (the tendency of an alternating electric current to become distributed within a conductor such that the current density is largest near the surface of the conductor and decreases with greater depths in the conductor) and associated power losses when used in high-frequency applications are reduced. The ratio of distributed inductance to distributed resistance is increased, relative to a solid conductor, resulting in a higher Q factor at these frequencies. In addition, the close proximity of the individual strands to one another, when separated into discrete windings, result in increased coupling and/or decreased conduction loss relative to other transformers utilizing other windings, as described herein. Various other characteristics of a Litz wire should generally be understood.

As used herein, a "single Litz wire" refers to one Litz wire having a plurality of individual strands, as described above. The single Litz wire is not limited by this disclosure with respect to length. As such, the single Litz wire may be any length. In addition, the number of individual strands located within the single Litz wire is not limited by this disclosure. That is, the single Litz wire may include at least two individual strands bundled together.

A "skin effect" is a tendency of a current to become distributed within an electrical current conductor such that the current density is largest near the surface of the conductor and decreases with grater depths in the conductor. That is, the electric current flows primarily at the "skin" of the electrical current conductor between the outer surface and a particular level called the skin depth. The skin effect causes an effective resistance of the electrical current conductor to increase at higher frequencies where the skin depth is smaller, thus reducing the effective cross-section of the electrical current conductor. The skin effect is due to opposing eddy currents induced by the changing magnetic field resulting from the current. At 60 Hertz (Hz) in copper, the skin depth is about 8.5 mm. At higher frequencies, the skin depth becomes smaller. Increased current resistance due to the skin effect can be mitigated using Litz wire.

A "proximity effect" is the result of current flowing through one or more nearby conductors, such as within a closely wound coil of wire, which causes the distribution of current within the first conductor to be constrained to smaller regions. This crowding of current provides an increase in an effective resistance of the circuit, which increases with the frequency of the current flowing through the circuit.

"Leakage inductance" is the result of an imperfectly coupled transformer. That is, leakage inductance is affected by design factors in a transformer. For example, the physical distance between windings may directly contribute to leakage inductance. The further the physical distance between windings, the greater the leakage inductance. This is because each winding behaves as a self-inductance constant in series with the respective ohmic resistance constant of the winding, which interacts with the mutual inductance constant of the transformer. The winding self-inductance constant and associate leakage inductance is due to leakage flux not linking with all turns of each imperfectly-coupled winding. The leakage flux alternately stores and discharges magnetic energy with each electrical cycle acting as an inductor in series with each of the primary and secondary circuits.

In certain two-winding transformers, leakage inductances exists in each winding because the magnetic flux is not perfectly coupled between the two windings. It may be desirable to minimize these leakage inductances because the leakage inductances generate unexpected ringing/resonance in voltage and current waveforms in the circuit, which may also be referred to as noise or EMI. The leakage inductances may also deteriorate the voltage gain of the transformer, which may leads to a loss of power and/or signal transferred through the transformer.

Certain transformers may utilize interleaved foil windings (e.g., sandwich winding) to achieve an increased coupling. However, while such transformers may potentially reduce leakage inductance, the flat shape of the conductor may suffer from high AC resistance. As such, transformers that include a plurality of windings within a single Litz wire as described herein may be desired.

Referring now to the drawings, FIG. 1A depicts an illustrative transformer, generally designated 100, according to various embodiments. As should be understood, the transformer 100 is a device that transfers electrical energy between two or more circuits through electromagnetic induction. The transformer 100 may be any type of transformer now known or later developed, including (but not limited to), a power transformer, an instrument transformer, a pulse transformer, a radio frequency (RF) transformer, an intermediate frequency (IF) transformer, and an audio transformer. In addition, the transformer 100 may be a part of any system that utilizes one or more transformers, including (but not limited to) charging systems, power conversion systems, switching systems, and the like. As such, the present disclosure further relates to any system comprising the transformer 100. The transformer 100 includes a core 110 and a single Litz wire 120. The transformer 100 may be arranged such that the single Litz wire 120 is wrapped around the core 110 to form a plurality of windings 130, as described in greater detail herein.

The core 110 may generally be any transformer core that is configured to support the windings 130. It should be understood that the core 110 may be constructed of one or more magnetic materials having a high magnetic permeability that is used to confine and guide a magnetic field generated by the electrical current passed through the Litz wire 120. In addition, the core 110 may be constructed of one or more materials that avoid or minimize hysteresis loss in the transformer 100. The core 110 may be a solid core constructed of a single mass of material or may be a laminated core constructed of a plurality of layers of material (which may be the same or different materials). Illustrative examples of a material that may be used to form at least a portion of the core 110 include an iron-based or a steel-based material, such as a silicon steel (including cold rolled grain oriented silicon steel), a ferrite (e.g., manganese-zinc ferrite, nickel-zinc ferrite, etc.) or the like; a metal alloy material, such as permalloy (nickel-iron alloy), mu-metal (nickel-iron-copper-chromium or nickel-iron-copper-molybdenum alloy), supermalloy (nickel-iron-molybdenum alloy); a vitreous metal; a powdered metal; a ceramic; and/or the like.

While FIG. 1A depicts the core 110 as being a toroidal core, this is merely illustrative. That is, the core 110 may be constructed of any shape, particularly shapes that are generally used for transformers. For example, the core 110 may have a cylindrical shape, an "I" shape, a "C" or "U" shape, an "E" shape (including a classical E core, an EFD core, an ETD core, and an EP core), a pot shape, a ring shape, a bead shape, a planar shape, or the like, as well as any combination of any of the foregoing. The toroidal shape of the core 110 may be constructed of a strip of material that is wound into a torus shape so as to ensure various grain boundaries of the strip are aligned. Such an alignment may affect the efficiency of the core 110 by increasing or reducing the magnetic reluctance of the core 110. In some embodiments, the core 110 may be toroidal so as to eliminate air gaps that are inherent in other core shapes, such as an "E-I" shaped core whereupon an "E" shaped core is joined with an "I" shaped core to form a ring shape. The toroidal shape of the core 110 may have a cross section that is square shaped, rectangular, circular, or ellipse shaped. It should be understood that the toroidal shape of the core 110 may create a magnetic field of circular loops inside the core, and the lack of sharp angles will constrain most (if not all) of the magnetic field to the core material. It should also be understood that the toroidal shape of the core 110 may result in the transformer 100 being more efficient relative to other transformers that utilize non-toroidal coils and/or reduces radiated electromagnetic interference relative to other transformers having non-toroidal coils.

In some embodiments, one or more portions of the core 110 may further be coated, laminated, impregnated, and/or the like with an insulative material. Such an insulative material may reduce or prevent eddy current losses within the transformer 100. Illustrative examples of an insulative material that may be placed on the core 110 include, but are not limited to, an oxide, an epoxy, a resin, a dielectric material, a polymer encapsulant, a poly(p-xylylene) polymer, and a ceramic. It should be understood that any one of the materials described herein, in addition to insulating the core 110, may further protect the core 110 from physical damage, improve the functionality of the core 110, and/or the like. In some embodiments, the core 110 may be coated via any method of coating now known or later developed, such as, for example, chemical vapor deposition (CVD) and physical vapor deposition (PVD). The core 110 may be coated, laminated, impregnated, and/or the like in either a uniform thickness of material or a non-uniform thickness. In some embodiments, one or more portions of the core 110 may be coated with an adhesive or the like to ensure that the Litz wire 120 is held in place on the core 110. Other materials that may be coated, laminated, impregnated, and/or the like on the core 110 should generally be understood.

The Litz wire 120 may generally be any Litz wire having a plurality of individual strands of conductive material now known or later developed. As such, the particular characteristics of the Litz wire 120 (as well as the individual strands therein) are not limited by the present disclosure. In some embodiments, the individual strands of the Litz wire may generally be held together by an outer jacket 125.

The cross sectional shape and/or size of the Litz wire 120 in general is not limited by the present disclosure. In some embodiments, the cross-sectional shape and/or size of the Litz wire 120 may be based on an amplitude of a current that is passed through the Litz wire 120. In addition, the individual strands within the Litz wire 120 may be identical in cross sectional shape and/or size, or may have differing cross sectional shapes and/or sizes. The cross-sectional shape and/or size of the individual strands, as well as particular groupings of strand(s) for a winding 130 may be based on a frequency of the current that is passed through the strand(s).

Figure 1B:
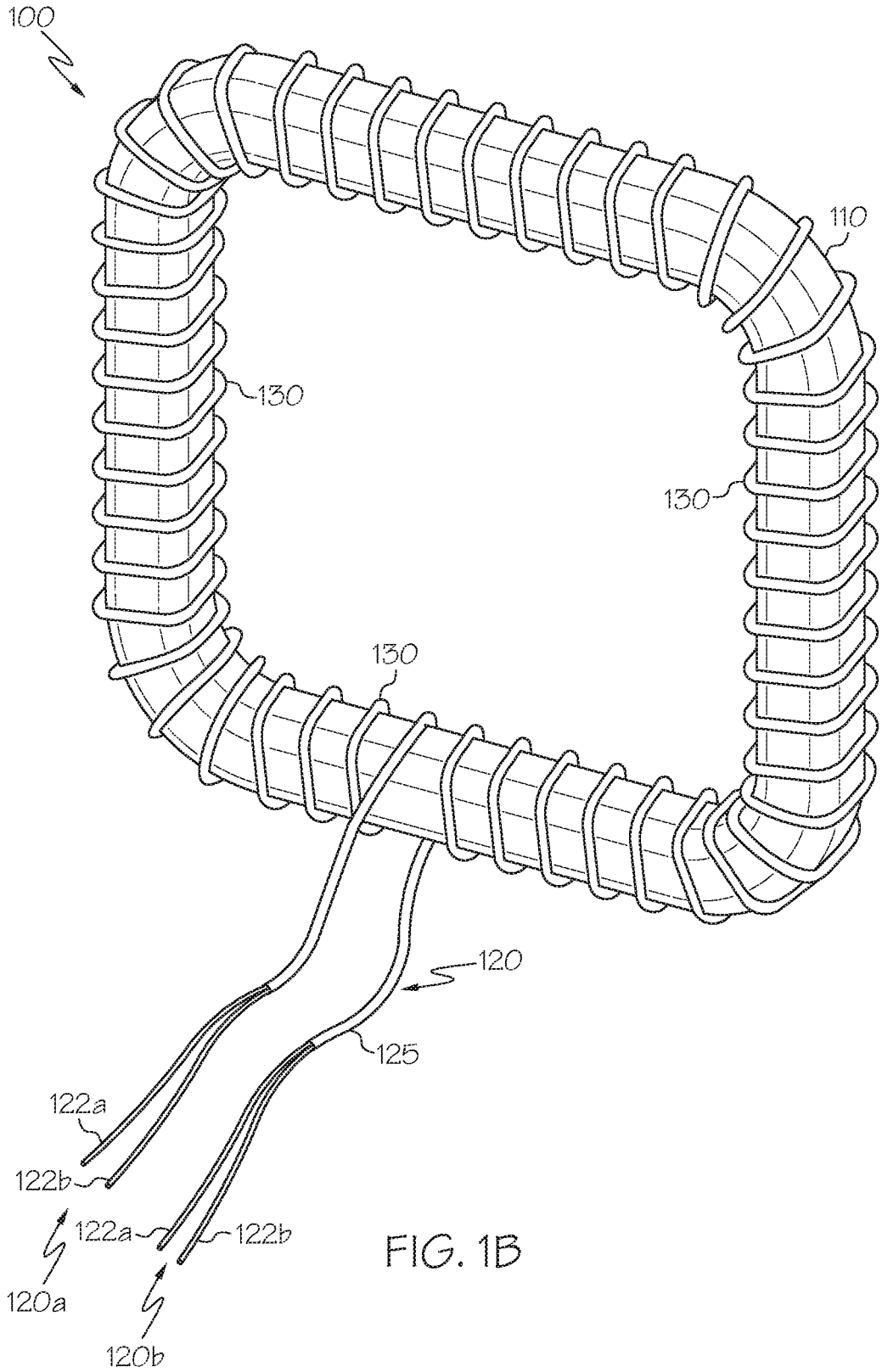
FIG. 1B depicts the illustrative transformer of FIG. 1A, showing at least a portion of the Litz wire being separated into a plurality of groups of individual strands according to one or more embodiments shown and described herein.
Figure 2:
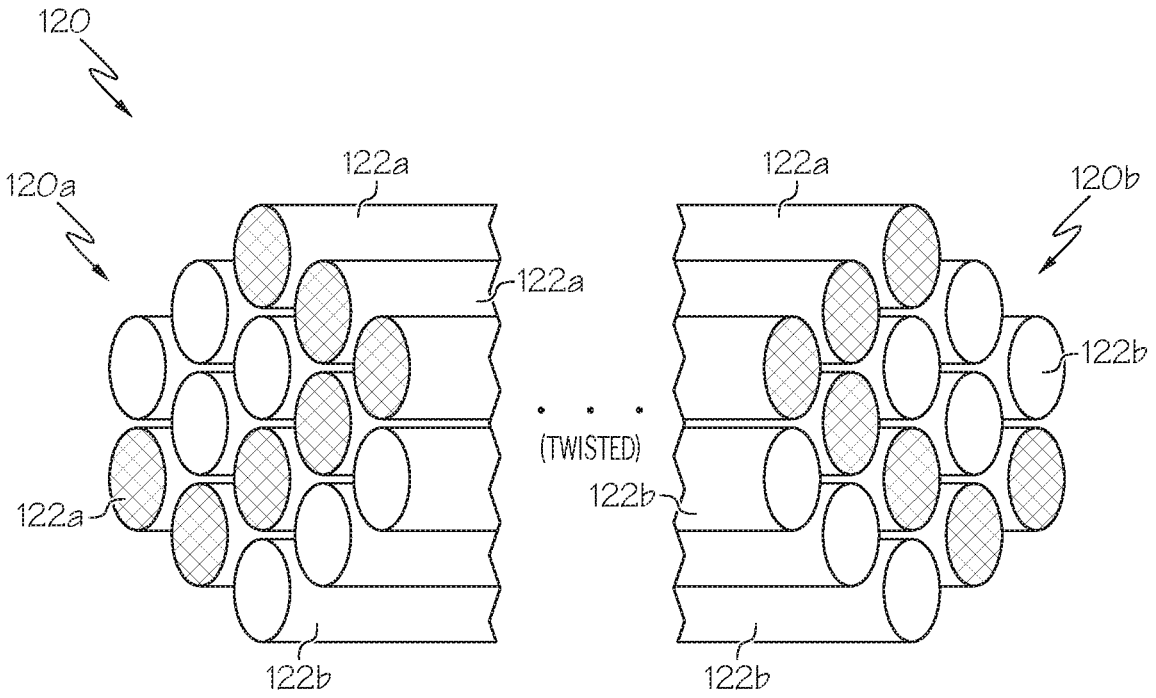
FIG. 2 depicts a perspective view of an illustrative Litz wire having a plurality of individual strands of conductive material according to one or more embodiments shown and described herein.

As described herein, the Litz wire 120 is wound around at least a portion of the core 110 and divided into groups of individual strands to form the windings 130 of the transformer 100. The Litz wire 120 forming the windings 130 around the core 110 carry electrical current, as described in greater detail herein. The transformer 100 includes a plurality of windings 130 within a single Litz wire 120, as described in greater detail herein. As shown in FIGS. 1B and 2, the plurality of windings 130 is more evident as a portion of the outer jacket 125 is removed to show the Litz wire 120 is separated into various groups of one or more strands that carry each of the windings 130. More specifically, the Litz wire 120 depicted in FIGS. 1B and 2 includes a first winding 130 (e.g., a primary winding) from a first group of one or more strands 122*a* from the Litz wire 120 and a second winding 130 (e.g., a secondary winding) from a second group of one or more strands 122*b* from the Litz wire 120. As such, the first end 120*a* of the Litz wire 120 includes a first end of the first group of strands 122*a* and a first end of the second group of strands 122*b*. In addition, the second end 120*b* of the Litz wire 120 includes a second end of the first group of strands 122*a* and a second end of the second group of strands 122*b*.

While only two windings 130 are depicted in FIGS. 1B and 2, it should be understood that the present disclosure is not limited to such. That is, the transformer 100 may include any number of windings greater than or equal to two, and is only limited by the number of individual strands in the Litz wire 120. More specifically, each of the windings 130 includes at least one individual strand from the plurality of strands in the Litz wire 120. However, each of the windings 130 may also include a plurality of strands in the Litz wire 120. As such, the number of windings may correspond to the number of groupings of individual strands in the Litz wire 120 such that if the transformer 100 includes n windings, then the Litz wire 120 is divided into n groups of individual strands.

In some embodiments, the various individual strands in the Litz wire 120 may be evenly distributed into a plurality of groups corresponding to the number of windings 130. For example, a Litz wire 120 that includes sixteen individual strands and is utilized for four windings may have four groups of four individual strands each, where each group of individual strands corresponds to a winding. In other embodiments, the various individual strands in the Litz wire 120 may be unevenly distributed into a plurality of groups corresponding to the number of windings 130. For example, a Litz wire 120 that includes fifteen individual strands and is utilized for two windings may have two groups of strands, where a first group of strands includes seven of the individual strands in the Litz wire 120 and a second group of strands includes eight of the individual strands in the Litz wire 120. In addition, the first group of strands corresponds to a first winding and the second group of strands corresponds to a second winding. In some embodiments, each of the individual strands in the Litz wire 120 may be used for a winding (i.e., there are no unused strands). In other embodiments, one or more of the individual strands in the Litz wire may not be used for a winding. In some embodiments, the number of strands that are used for a particular winding 130 may be dependent on the amplitude and/or frequency of the current that is passed through the strands.

Use of the Litz wire 120 for the windings 130 in the transformer 100 inherently provides shielding for the windings 130 to avoid or minimize the skin effect and proximity effect losses because each of the strands in the Litz wire 120 is insulated, as described in greater detail herein. In addition, use of a single Litz wire 120 for the windings 130 decreases leakage inductance and increases the coupling between the windings 130 because the windings 130 are in close proximity with one another within the single Litz wire 120, as described herein. As a result, less loss and lower electromagnetic interference results, relative to transformers that do not utilize a Litz wire.

Figure 3:
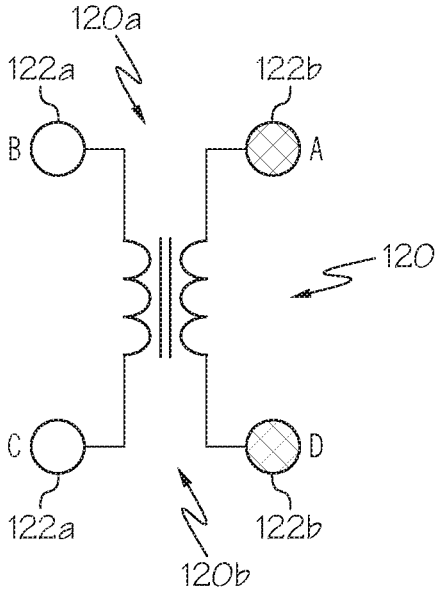
FIG. 3 schematically depicts an electrical diagram of an illustrative transformer coupled to a plurality of terminal pairs according to one or more embodiments shown and described herein.

Each winding 130 may be coupled to a pair of terminals (e.g., voltage potentials, load wires, and/or the like), as depicted in FIG. 3. More specifically, the first group of one or more strands 122*a* may be coupled between terminal B (e.g., a first voltage potential) and terminal C (e.g., a second voltage potential). In addition, the second group of one or more strands 122*b* may be coupled between terminal A (e.g., a third voltage potential) and terminal D (e.g., a fourth voltage potential). As such, the first end 120*a* of the Litz wire 120 may be coupled to terminals A and B and the second end 120*b* of the Litz wire 120 may be coupled to terminals C and D. The various characteristics of terminals A, B, C, and D should generally be understood. While terminals A and D are referred to herein as voltage potentials, this is a nonlimiting example. That is, in embodiments where the second group of strands 122*b* are a secondary winding, terminals A and D may be load terminals that receive the electrical energy that is transmitted from the primary winding (i.e., the first group of strands 122*a*) coupled between terminals B and C.

Figure 4:
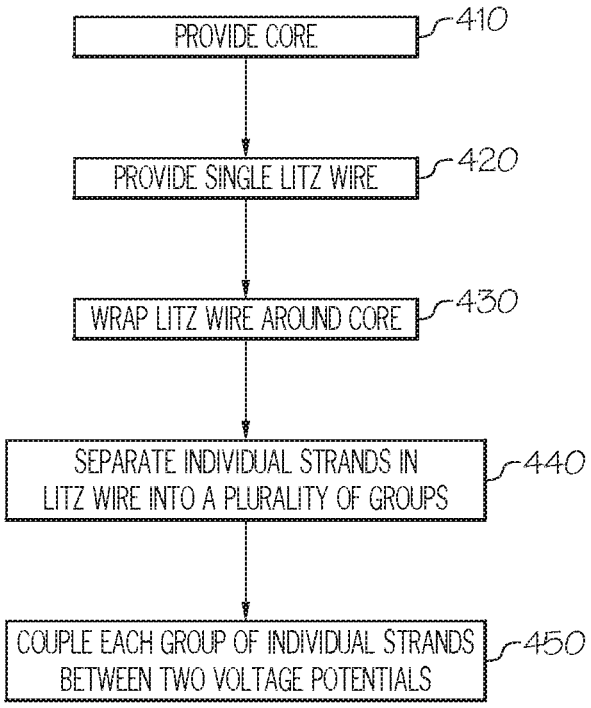
FIG. 4 depicts a flow diagram of an illustrative method of providing a transformer having windings constructed of a single Litz wire according to one or more embodiments shown and described herein.

FIG. 4 depicts a flow diagram of providing a transformer according to one or more embodiments. The core may be provided at step 410 and the single Litz wire may be provided at step 420. The single Litz wire may then be wrapped (i.e., coiled) around the core, as described in greater detail herein.

At step 440, the individual strands may be separated into a plurality of groups. That is, a group of individual strands may be separated from the plurality of strands in the Litz wire for each winding of the transformer, as described in greater detail herein. The groups may include one or more of the individual strands. In addition, the various strands in a particular group may be selected based on the characteristics of the current that is to be passed through the group of individual strands, as described in greater detail herein.

Once the individual strands within the single Litz wire have been separated, each group of strands may be coupled between a pair of terminals, as described in greater detail herein. That is, a first group of individual strands representing a first winding may be coupled between a first pair of terminals (e.g., a first terminal and a second terminal). A second group of individual strands representing a second winding may be coupled between a second pair of terminals (e.g., a third terminal and a fourth terminal). The transformer may then be utilized for various purposes, as should generally be understood.

EXAMPLE

A transformer was constructed according to the various embodiments described herein. More specifically, the transformer included a toroidal core having two windings formed from a single Litz wire that was divided into two groups of individual strands. The first group of individual strands within the Litz wire was coupled between a first terminal and a second terminal, and the second group of individual strands within the Litz wire was coupled between a third terminal and a fourth terminal. A current having a frequency of 100 kHz was passed through the windings of the transformer. The leakage inductance of the transformer was determined to be about 103 microhenrys (μH). This represents a decrease in leakage inductance of about 60% relative to a measured leakage inductance of a two winding transformer that does not utilize a single Litz wire (leakage inductance of about 265 μH).

It should now be understood that the embodiments disclosed herein include transformers having a plurality of windings formed from a single Litz wire. More specifically, the single Litz wire includes a plurality of individual and individually shielded strands of conductive material that are closely bound together within the Litz wire. The various individual strands are grouped into a plurality of strand groups, where each group corresponds to a particular winding. In addition, each strand group (i.e., individual winding) is coupled between a pair of terminals (e.g., a pair of voltage potentials, a pair of load terminals, or the like). Due to the close proximity and electrical isolation of the individual strands within the single Litz wire, the individual strands can increase coupling by reducing leakage inductance between windings and/or decrease conduction loss by reducing AC resistance. The resulting transformer operates more efficiently relative to other transformers that utilize other types of windings. In addition, the resulting transformer is less likely to be damaged due to conduction loss and does not add extra bulk or construction costs that would occur with additional wires and/or additional shielding in wires.

While particular embodiments and aspects of the present disclosure have been illustrated and described herein, various other changes and modifications can be made without departing from the spirit and scope of the disclosure. Moreover, although various aspects have been described herein, such aspects need not be utilized in combination. Accordingly, it is therefore intended that the appended claims cover all such changes and modifications that are within the scope of the embodiments shown and described herein.

What is claimed is:

1. A transformer comprising:

a first terminal, a second terminal, a third terminal, and a fourth terminal;

a core; and a single Litz wire comprising a plurality of individual strands of conductive material, wherein a first group of one or more strands from the plurality of individual strands is coupled between the first terminal and the second terminal to create a first winding of the transformer and a second group of one or more strands from the plurality of individual strands is coupled between the third terminal and the fourth terminal to create a second winding of the transformer.

2. The transformer of claim 1, wherein the single Litz wire is wrapped around at least a portion of the core.

3. The transformer of claim 1, wherein the first group and the second group each comprise an equal number of individual strands relative to one another.

4. The transformer of claim 1, wherein the first group and the second group each comprise an unequal number of individual strands relative to one another.

5. The transformer of claim 1, wherein a number of the individual strands within each one of the first group and the second group is based on one or more of an amplitude and a frequency of a current that is passed through the individual strands.

6. The transformer of claim 1, wherein at least one of a cross sectional shape and a cross sectional size of the single Litz wire is based on an amplitude of a current that is passed through the single Litz wire.

7. The transformer of claim 1, wherein the transformer exhibits a decreased leakage inductance relative to an alternative transformer comprising a single wire for each winding of the alternative transformer.

8. The transformer of claim 1, wherein the transformer exhibits less electromagnetic interference relative to an alternative transformer comprising a single wire for each winding of the alternative transformer.

9. The transformer of claim 1, wherein a coupling between each one of the plurality of windings is increased relative to an alternative transformer comprising a single wire for each winding of the alternative transformer.

10. A transformer comprising:

a first terminal, a second terminal, a third terminal, and a fourth terminal;

a toroidal core; and a single Litz wire wrapped around at least a portion of the toroidal core, the single Litz wire comprising a plurality of individual strands of conductive material, wherein a first group of one or more strands from the plurality of individual strands is coupled between the first terminal and the second terminal to create a first winding of the transformer and a second group of one or more strands from the plurality of individual strands is coupled between the third terminal and the fourth terminal to create a second winding of the transformer.

11. The transformer of claim 10, wherein the first group and the second group each comprise an equal number of individual strands relative to one another.

12. The transformer of claim 10, wherein the first group and the second group each comprise an unequal number of individual strands relative to one another.

13. The transformer of claim 10, wherein a number of the individual strands within each one of first group and the second group is based on one or more of an amplitude and a frequency of a current that is passed through the individual strands.

14. The transformer of claim 10, wherein the toroidal core is formed from a single mass of material.

15. The transformer of claim 10, wherein the toroidal core is formed from a plurality of layers of material.

16. The transformer of claim 10, wherein the toroidal core is formed from silicon steel.

17. A system comprising:

a transformer, wherein the transformer comprises:

a first terminal, a second terminal, a third terminal, and a fourth terminal;

a core; and a single Litz wire wrapped around at least a portion of the toroidal core, the single Litz wire comprising a plurality of individual strands of conductive material, wherein a first group of one or more strands from the plurality of individual strands is coupled between the first terminal and the second terminal to create a first winding of the transformer and a second group of one or more strands from the plurality of individual strands is coupled between the third terminal and the fourth terminal to create a second winding of the transformer.

18. The system of claim 17, wherein the first group comprises a first number of individual strands of the single Litz wire and the second group comprises a second number of individual strands of the single Litz wire.

19. The system of claim 18, wherein the first number is equal to the second number.

20. The system of claim 18, wherein the first number is not equal to the second number.

* * * * *